US007194066B2

(12) United States Patent
Tiearney, Jr. et al.

(10) Patent No.: US 7,194,066 B2
(45) Date of Patent: Mar. 20, 2007

(54) APPARATUS AND METHOD FOR LIGHT WEIGHT HIGH PERFORMANCE TARGET

(75) Inventors: Thomas C. Tiearney, Jr., Waukesha, WI (US); Brian D. Lounsberry, Thiensville, WI (US)

(73) Assignee: General Electric Company, Schenectady, NY (US)

( * ) Notice: Subject to any disclaimer, the term of this patent is extended or adjusted under 35 U.S.C. 154(b) by 69 days.

(21) Appl. No.: 10/709,042

(22) Filed: Apr. 8, 2004

(65) Prior Publication Data

US 2005/0226387 A1 Oct. 13, 2005

(51) Int. Cl.
*H01J 35/08* (2006.01)
*H01J 35/10* (2006.01)

(52) U.S. Cl. ..... 378/143; 378/144

(58) Field of Classification Search ..... 378/143, 378/144

See application file for complete search history.

(56) References Cited

U.S. PATENT DOCUMENTS 3,579,022 A 5/1971 Hennig
3,649,355 A 3/1972 Hennig
3,689,795 A 9/1972 Benesovsky
3,887,723 A * 6/1975 Kaplan et al. ..... 427/58
4,109,058 A * 8/1978 Love et al. ..... 378/144
4,132,917 A 1/1979 Bildstein et al.
4,516,255 A 5/1985 Petter et al.
4,571,286 A * 2/1986 Penato ..... 205/118
4,573,185 A * 2/1986 Lounsberry et al. ..... 378/125
4,972,449 A * 11/1990 Upadhya et al. ..... 378/144
4,990,402 A 2/1991 Kneringer et al.
5,125,020 A * 6/1992 Penato et al. ..... 378/143
5,138,645 A * 8/1992 Penato et al. ..... 378/144
5,825,848 A * 10/1998 Virshup et al. ..... 378/144
5,875,228 A * 2/1999 Truszkowska ..... 378/144
6,554,179 B2 4/2003 Horner et al.
2003/0006269 A1* 1/2003 Horner et al. ..... 228/122.1

FOREIGN PATENT DOCUMENTS

JP 05266838 A * 10/1993

* cited by examiner

*Primary Examiner*—Edward J. Glick
*Assistant Examiner*—Irakli Kiknadze

(57) ABSTRACT

An x-ray anode for use in an x-ray tube is provided. The x-ray anode includes a substrate material, a target material, and one or more graded coefficient of thermal expansion material layers. The target material is coupled to the one or more graded coefficient of thermal expansion material layers and the graded coefficient of thermal expansion material layers are coupled to the substrate material. A method of making the x-ray anode is also provided.

17 Claims, 2 Drawing Sheets

APPARATUS AND METHOD FOR LIGHT WEIGHT HIGH PERFORMANCE TARGET

BACKGROUND OF INVENTION

The present invention relates generally to an x-ray anode, and more particularly, to an x-ray anode having graded coefficient of thermal expansion material layers between the substrate and the target material.

There is a desire in the medical imaging industry to accommodate an increasing customer preference for shorter scan times in Computed tomography (CT) x-ray scanners. In order to accomplish the shorter scan times, the x-ray tube on the CT scanner is rotated around a gantry at increasing speeds and the instantaneous power of the x-ray tube directed at the target material on the anode must be increased to maintain X-ray flux. These two requirements require the target diameter on the anode to be maximized within the allowable design envelope and the anode rotation speed to be increased in order to allow the target to handle the high powers required by the shorter scan times.

As the x-ray tube on the CT scanner is rotated around a gantry at increasing speeds, the Hertzian load on the anode bearings dramatically increases. Also, by increasing instantaneous power on the anode, there is an increase in localized temperature on the target of the anode and an increase in temperature variation across the anode. The current anode materials of construction limit the allowable load and instantaneous power that the anode may be subjected to. Thus, the parameters (target diameter and anode rotation speed) are limited by excessive mass, e.g. formed from a solid target material, or unacceptable burst strength of the target material on the anode. The excessive mass increases the load upon the anode bearings; therefore it is desirous to have lighter target material. The localized temperature and temperature variation affects the burst strength, therefore it is desirous to have an anode that is less susceptible to the temperature variations by increasing its strength (burst resistance).

U.S. Pat. No. 6,554,179 teaches a method of reaction brazing a solid target material made from refractory metals to a carbon composite to achieve phase stability between the materials and to achieve high thermal conductivity, which dissipates the localized heat generated on the target material. A slurry coating is applied to graphite or carbon composite containing reactive metal carbides, refactory metal borides, and metal powders to form a layer to which the solid refractory metal alloy can be brazed. The target material is made from solid refractory metal alloys of tungsten (W) or Molybdenum (Mo). The carbonaceous material is preferred to have a matched coefficient of thermal expansion with the target material, otherwise high strains result between the materials during expected temperature excursions. The solid target material adds a significant amount of weight to the anode, thus increasing the overall density of the anode. Furthermore, various methods of making the slurry coating are taught, including methods of applying the slurry to the x-ray anode. Also, heat-treating temperatures and durations are presented for bonding the various refractory metal to the carbonaceous support.

It would therefore be desirable to provide an x-ray anode capable of handling an increased target diameter and anode rotation speeds by designing a lighter weight anode having materials with high strength (burst resistance), high thermal conductivity and reduced strain between the material layers, while ensuring phase stability in the target region over the life of the anode.

SUMMARY OF INVENTION

The present invention provides an x-ray anode for use in an x-ray tube. The x-ray anode includes a substrate material, a target material, and one or more graded coefficient of thermal expansion material layers. The target material is coupled to the one or more layers of graded coefficient of thermal expansion (CTE) material, and the layers of graded CTE material are coupled to the substrate material.

A first method of making an x-ray anode includes providing a substrate having a target location, coating the target location of the substrate with a slurry mixture to form one or more graded CTE material layers, drying the coating, and depositing a target material on the outer most surface of the one or more layers of graded CTE material. The target material, material layers and substrate material are then heated to bond them all together.

A second method of making an x-ray anode includes providing a substrate having a target location, coating the target location of the substrate with a slurry mixture to form one or more graded CTE material layers, sintering the coating, depositing a target material on the outer most surface of one or more layers of graded CTE materials, and then heating to bond the target material, material layers and substrate material.

One advantage of the invention is that an overall lower density of the anode is achievable. This enables the diameter of the anode to be increased without overloading the bearings. Additionally, the large diameter, lightweight target may operate in rotation speed ranges well in excess of conventional anodes because the anode has been designed to withstand the higher stress and strains caused by the loading. Furthermore, the chemistry of the graded CTE material layers reduces the propensity for undesirable formation, such as tungsten carbide formation, improving the anode's reliability over its life. Also, the target adherence and reliability over the x-ray tube life are enhanced by grading the slurry mixture layers with differing CTEs so that even a substrate having very low or a high CTE may still retain the refractory metal target intact.

Other aspects and advantages of the present invention will become apparent upon the following detailed description and appended claims, and upon reference to the accompanying drawings.

DETAILED DESCRIPTION

Figure 1:
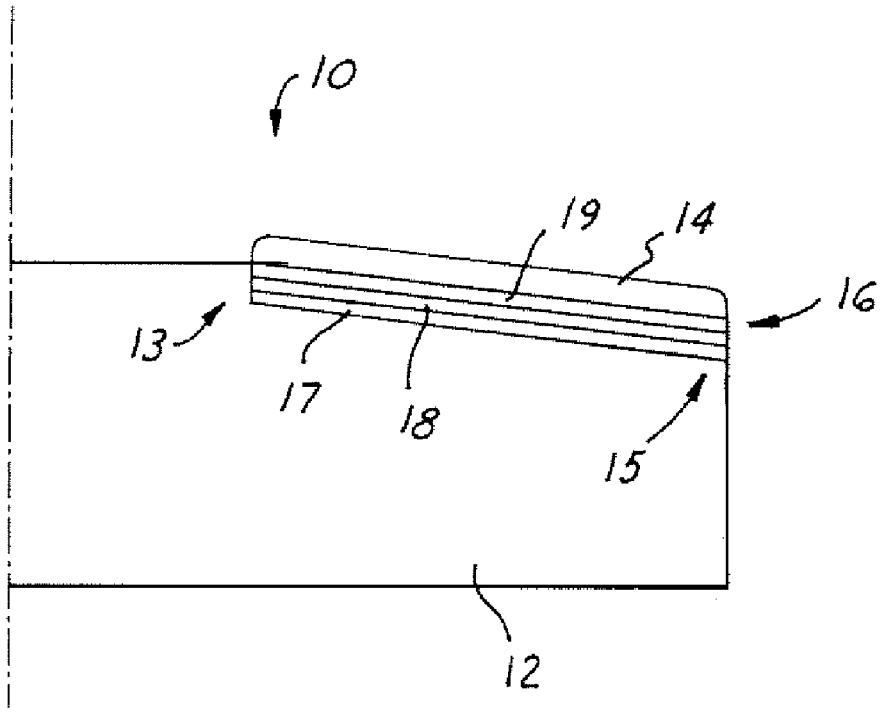
FIG. 1 is a partial cross-sectional view of an x-ray anode according to one embodiment the present invention.

In the following figures the same reference numerals will be used to illustrate the same components in the various views. The present invention is described with respect to a computed tomography device. However, those skilled in the art will recognize that the present invention has several applications within the medical imaging field and outside the medical imaging field. That is, the present invention is suitable for applications that employ rotating x-ray anodes. The present invention is also suitable for applications that require a static x-ray anode having a substrate material with differing physical properties from the target material.

Referring now to FIG. 1, a partial cross-sectional view of an x-ray anode 10 is illustrated having a substrate material 12 and a target material 14 coupled together through one or more layers 16 of graded coefficient of thermal expansion (CTE) material. Although an x-ray anode 10 is illustrated, the present invention applies equally to other types of x-ray anodes for use in x-ray tubes.

The substrate material 12 of this embodiment is made from compatible material for use in supporting a refractory metal for use in an x-ray anode application. The substrate material 12 is chosen for its hoop strength. The substrate material 12 has a maximized thermal conductivity, primarily in the through-thickness direction as would be recognized by one having skill in the art of x-ray anodes. Also, the material is chosen having other properties such as low density and higher emissivity. Ideally, although not required, the substrate material 12 is made from a lightweight material. The substrate material 12 may be made from a composite or monolithic material. Depending upon the material selected for the substrate material 12, it may have a coefficient of thermal expansion (CTE) around 0 or $1\times10^{-6}/°$ C., ranging as high as $9\times10^{-6}/°$ C. The CTE of the substrate material is not critical and may have any value. The CTE of the substrate material will be used in order to determine the desired CTE of each of the graded coefficient of thermal expansion layers used to couple the substrate to the target.

The substrate material 12 may be a carbonaceous or carbon-fiber material. Also, the carbon based substrate material 12 may be a woven structure of high strength carbon fibers having a low coefficient of thermal expansion in the plane of the target face. Alternatively, the carbon based substrate material 12 is tailored having a woven composite for maximum hoop strength via the use of a cylindrical weave of high strength fibers, and having a maximum thermal conductivity in the through thickness and radial directions having fibers with high thermal conductivity in these directions. Other carbonaceous materials are also contemplated for the substrate material 12 including, graphite, pyrolytic graphite, fiber-reinforced pyrolytic graphite and carbon-carbon composites.

Furthermore, the substrate material 12 is prepared for use as an x-ray anode 10 and has a prepared surface between a first location 13 and a second location 15 for coupling of one or more graded coefficient of thermal expansion material layers 16 and a target material 14 thereto. The target location or surface between a first location 13 and a second location 15 is shown primarily as a flat surface with a small side wall, wherein the one or more graded coefficient of thermal expansion material layers 16 are immediately adjacent the substrate material 12 at first location 13. Alternatively, the surface of the substrate material 12 between a first location 13 and a second location 15 may be a substantially straight surface. Also, although shown differently in this embodiment, the graded coefficient of thermal expansion material layers 16 need not be immediately adjacent the substrate material 12 at first location 13. However, the first layer 17 of the one or more graded coefficient of thermal expansion material layers 16 is coupled to the substrate material 12 between the first location 13 and the second location 15.

The target material 14 of this embodiment is made from refractory metals suitable for use in an x-ray anode application. The target material 14 may be made from elemental tungsten or elemental molybdenum. The target material 14 may be made from a molybdenum alloy, e.g. TZM or TZC (such as 99% Mo and 1% Ti+Zr+C). Also, the target material 14 may be made from a tungsten alloy containing an amount of Rhenium Re (such as 95% tungsten and 5% Re). These single crystal or polycrystalline materials typically have coefficients of thermal expansion in the range of 4 to $6\times10^{-6}/°$ C. The target material 14 is coupled to the one or more graded coefficient of thermal expansion material layers 16.

In this embodiment of the invention, the target material 14 may be made by using chemical vapor deposition (CVD), physical vapor deposition (PVD), or low pressure plasma spray (LPPS) to couple the alloy or elemental refractory metal to the thermal expansion material layers 16 coupled to the substrate material 12 of x-ray anode 10. A lightweight target is achieved by using CVD, PVD, or LPPS methods to form a light composite or monolithic material (having an overall lower density of the anode) on the target material 14, resulting in the x-ray anode tailored for maximum burst strength and thermal conductivity while exhibiting the desired properties of lower stress and strain due to temperature fluctuation expected in its intended operation without concern for its CTE. The lower overall density of the x-ray anode enables the design envelope to be expanded for higher performance.

Alternatively, the target material 14 may be made from a solid single crystal or polycrystalline material, which will improve the strength of the x-ray anode 10 when it is coupled to the thermal expansion material layers 16, by making it less susceptible to stress and strain caused by thermal variations without concern for CTE of the material layers.

The graded coefficient of thermal expansion material layers 16 coupling the substrate material 12 to the target material 14 are made from a slurry mixture. The graded coefficient of thermal expansion material layers 16, in this embodiment of the present invention, has three layers, i.e., a first layer 17, a second layer 18, and a third layer 19. Although three layers are shown, one or more layers are acceptable. The slurry mixture includes, in any combination, materials including, but not limited to, tungsten, tungsten borides, tungsten carbides, molybdenum, molybdenum borides, molybdenum carbides, zirconium, hafnium, hafnium carbides, binders or other materials acceptable for use with x-ray anode. The refractory metals and their constituent carbides and borides are typically provided in the slurry mixture as fine particulate powders (typically having a particle size smaller than 50 mm). Carbon fibers are then added to the slurry mixture in sufficient quantities to achieve a desired CTE. Different slurry mixtures are made for each graded layer 17, 18, 19 having different CTEs. The carbon added to the slurry mixture may be chopped carbon fiber, carbon fibers or other materials having the desired CTE increasing or reducing properties. Specifically, the coefficient of thermal expansion of the slurry mixture for each dried layer in the one or more graded coefficient of thermal expansion material layers 16 may be varied by increasing or decreasing the carbon fibers in the mixture, i.e., the key to grading the expansion coefficient is by altering the carbon fibers in the slurry mixture for each of the graded layers.

The carbon fibers may be of any form including chopped and fibrous carbon fibers. The carbon fibers may be chopped pitch fibers with CTE along the fiber axis in the 0 to $1\times10^{-6}/°$ C. range. The carbon fibers may be added, as necessary, to the slurry mixture in order to achieve the required coefficient of thermal expansion. For example, for a thermal expansion material layer 16 having three layers, the carbon fibers may be added in volumes of 67%, 50%, and 33% to the slurry mixture for three layers, respectfully. In another example having only two thermal expansion material layers, the carbon fibers may be added in volumes of 67% and 33%. Of course the volume of the carbon fibers added to each layer will depend upon the desired CTE of each layer. These embodiments provide a layer 16 with graded CTEs.

Each of the one or more graded coefficient of thermal expansion material layers 16 is coupled sequentially upon the substrate material. Specifically, as shown in this embodiment, the first layer 17 is coupled to the substrate material 12 between the first location 13 and the second location 15. The third layer 19 is coupled to the second layer 18, which is coupled to the first layer 17. Additionally, each of the layers 17, 18, 19 may be layered horizontally from the substrate surface.

In this embodiment of the present invention, each of the graded coefficient of thermal expansion material layers has an approximate coefficient of thermal expansion (CTE) averaging between each of the adjacent materials. For example, each of the three graded layers 17, 18, 19 will have a CTE of 2, 3, and $4\times10^{-6}/°$ C., respectively, on the x-ray anode 10 with a substrate material 12 having a CTE of $1\times10^{-6}/°$ C. and a track material 14 having a CTE of $5\times10^{-6}/°$ C. Alternatively, one would recognize that the gradient may be in the other direction. Also, one would recognize that the desired CTE of each material layer would depend upon the desired number of material layers and the CTE of the substrate and track materials.

Optionally, each of the one or more graded coefficient of thermal expansion material layers 16 may have differing CTEs. For example, the substrate material 12, the target material 14, the first layer 17, the second layer 18, and the third layer 19 may have CTEs of 1, 6, 1.5, 4, and $5\times10^{-6}/°$ C., respectively. The CTE of each layer may differ. Each layer of the x-ray anode may have a CTE that differs by $2\times10^{-6}/°$ C.; and an improved CTE differential of $1\times10^{-6}/°$ C. Also, each layer of the x-ray anode may have a CTE that differs by less than $1\times10^{-6}/°$ C.

In the embodiments described, the x-ray anode 10 is a rotating x-ray anode. Alternatively, the x-ray anode may be any other type of x-ray anode.

Figure 2:
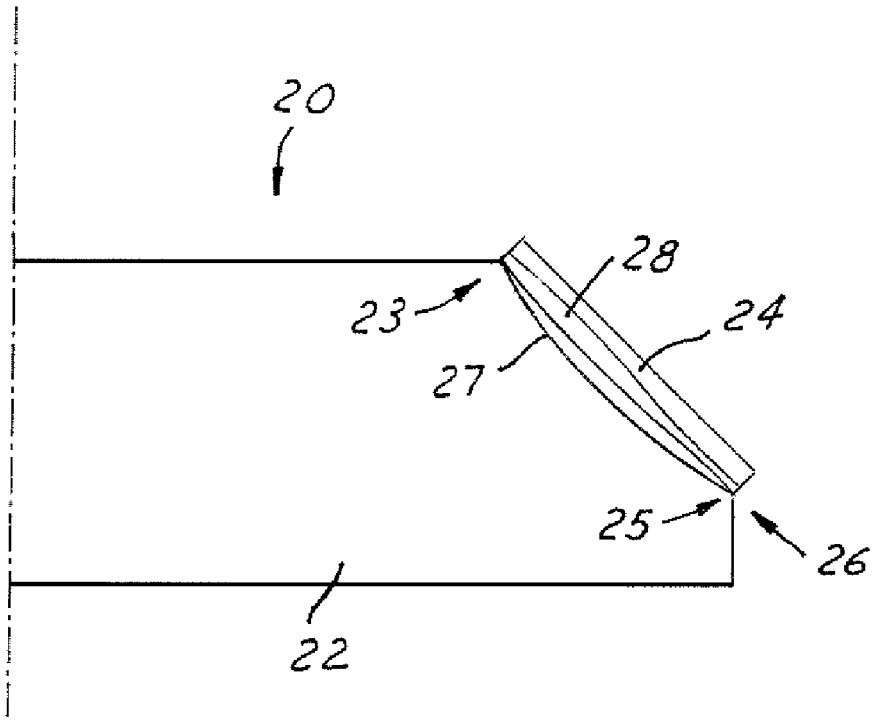
FIG. 2 is a partial cross-sectional view of an x-ray anode according to another embodiment the present invention.

Referring now to FIG. 2, a partial cross-sectional view of an x-ray anode 20 according to another embodiment of the present invention is illustrated having a substrate material 22 and a target material 24 coupled together through one or more graded coefficient of thermal expansion material layers 26. Again, although an x-ray anode 20 is illustrated, the present invention applies equally to other types of x-ray anodes for use in x-ray tubes.

The substrate material 22 is prepared for use as an x-ray anode and has a prepared surface, i.e. target location, between a first location 23 and a second location 25 for coupling of one or more graded coefficient of thermal expansion material layers 26 and a target material 24 thereto. The surface of the substrate material 22 between a first location 23 and a second location 25 is shown having a curved surface (not having a side wall as shown in FIG. 1). Alternatively, one will recognize that the surface between a first location 23 and a second location 25 may be a straight or substantially straight.

The graded coefficient of thermal expansion material layer 26, in this embodiment of the present invention, has two layers, i.e., a first layer 27, and a second layer 28. Although two layers are shown, one or more layers are acceptable.

In this embodiment of the present invention, each of the graded coefficient of thermal expansion material layers has an approximate coefficient of thermal expansion (CTE) averaging between each of the adjacent materials. For example, the two graded layers 27, 28 will have a CTE of 2.5 and $4\times10^{-6}/°$ C., respectively, on the x-ray anode 20 with a substrate material 22 having a CTE of $1\times10^{-6}/°$ C. and a track material 24 having a CTE of $5.5\times10^{-6}/°$ C. Alternatively, one would recognize that the gradient may be in the other direction. Also, one would recognize that the desired CTE of each material layer would depend upon the desired number of material layers and the CTE of the substrate and track materials.

Optionally, each of the one or more graded coefficient of thermal expansion material layers 26 may have differing CTEs. For example, the substrate material 22, the target material 24, the first layer 27, and the second layer 28 may have CTEs of 1, 6, 2, and $5\times10^{-6}/°$ C., respectively. The CTE of each layer may differ. Each layer of the x-ray anode may have a CTE that differs by $2\times10^{-6}/°$ C.; and an improved CTE differential of $1\times10^{-6}/°$ C. Also, each layer of the x-ray anode may have a CTE that differs by less than $1\times10^{-6}/°$ C.

In the embodiments described, the x-ray anode 20 is a rotating x-ray anode. Alternatively, the x-ray anode may be any other type of x-ray anode.

Figure 3:
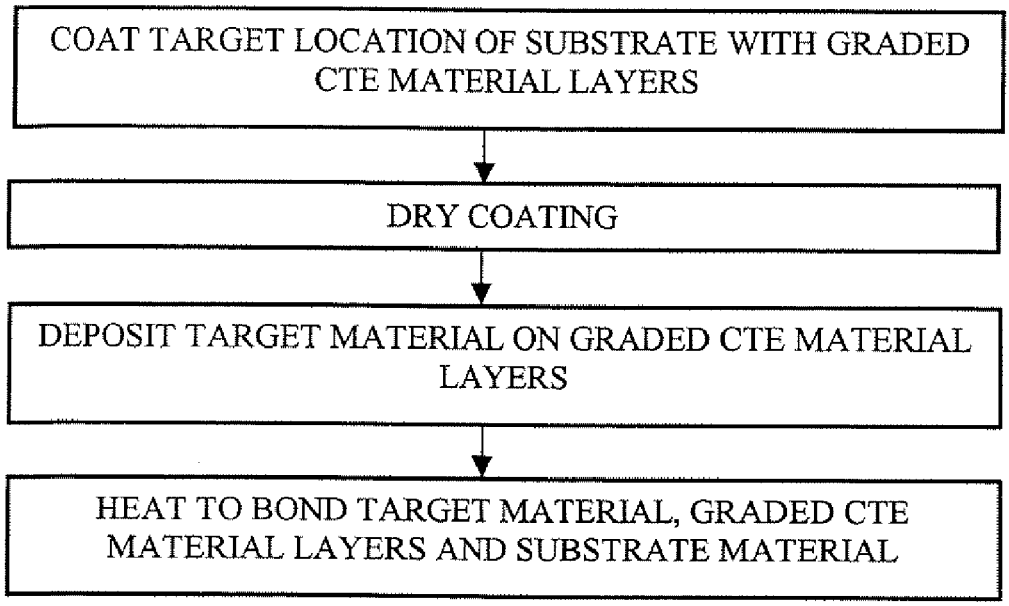
FIG. 3 shows a method of making an x-ray anode according to the present invention.

FIG. 3 shows a method of making an x-ray anode according to the present invention. The method of making an x-ray anode includes providing a substrate having a target location, coating the target location of the substrate with a slurry mixture that forms the one or more graded coefficient of thermal expansion material layers, and drying the material of each CTE layer. Thereafter, a target material is deposited on the outer most surface of the one or more graded coefficient of thermal expansion material layers. Finally, the target material, material layers and substrate material are heated in order to bond them together.

The substrate is selected having a material and shape suitable for use as an x-ray anode.

Each of the one or more graded coefficient of thermal expansion material layers is formed by coating the target location of the substrate with the slurry mixture (described above) having a specific CTE for each layer. Each coating is applied using techniques known to those having skill in the art. The coatings are allowed to dry after the slurry mixture is applied on each of the required layers. Optionally, each coating of the slurry mixture may be allowed to dry before applying the next coat. The drying is accomplished at 125° C. or at an acceptable temperature known to those in the art. In some instances, the drying temperature will need to be elevated to a sintering temperature before applying the next layer.

The target material is then deposited onto the graded coefficient of thermal expansion material layers. The target material may be deposited by using CVD, PVD, or other methods know to those in the art. Optionally if the target material is a solid, its shape must be formed to fit the substrate with the graded CTE layers positioned there between.

The last step in the method is to heat the x-ray anode at a temperature that will bond the target material, the graded coefficient of thermal expansion material layers, and the substrate material together. The temperature and duration of the heat-treating will be dependent upon the material combination of the substrate, the slurry used to form the graded CTE layers, and the target. A method of heat-treating is cited in the referenced patent (see above) and is known to those having skill in the art. A typical heat-treating temperature for layers containing Hf compounds is 1865° C. and for layers containing no Hf compounds is 2350° C.

One example of making an x-ray anode is by heat-treating it at a temperature of 2350° C. after the x-ray anode is made. The x-ray anode is made from a substrate having a woven structure of high strength carbon fibers, three CTE material layers applied to the substrate that forms the graded CTE layer, where each of the three layers are made from a slurry mixture (containing W, W2B, WC, chopped carbon fibers, and binders) with a differing CTE in each layer and each layer is dried after it is applied, and a target made from tungsten alloy (95% W, 5% Re) using CVD method to deposit the target material upon the surface of the graded CTE layer.

Optionally, the heat-treating may include a weight applied to the target material to facilitate the bonding process of the materials.

Figure 4:
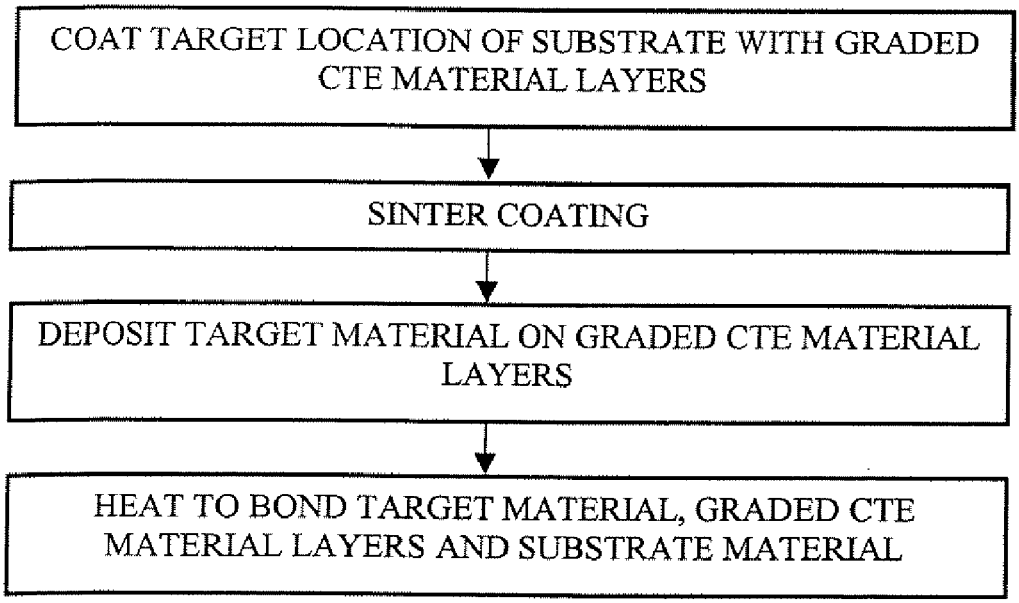
FIG. 4 shows an alternate method of making an x-ray anode according to the present invention.

FIG. 4 shows an alternate method of making an x-ray anode according to the present invention. The method of making an x-ray anode includes providing a substrate having a target location and then coating the target location of the substrate with a slurry mixture that forms the one or more graded coefficient of thermal expansion material layers. Thereafter the coating is sintered and a target material is deposited on the outer most surface of the one or more graded coefficient of thermal expansion material layers. Finally, the target material, material layers and substrate material are heated in order to bond them together.

Each of the one or more graded coefficient of thermal expansion material layers is formed by coating the target location of the substrate with the slurry mixture (described above) having a specific CTE for each layer. The coatings are sintered after the slurry mixture is applied for each of the required layers. Optionally, each coating of the slurry mixture may be sintered after it is applied. The sintering temperature will depend upon the materials selected for the slurry and the substrate. The sintering may be at 1865° C. or at an acceptable temperature known to those in the art. For example the sintering temperature may be at 1865° C., where the x-ray anode is made from a woven structure of high strength carbon fibers, one or more graded coefficient of thermal expansion layers made from a slurry mixture (containing W, W2B, HfC, Hf, chopped carbon fibers, and binders) with a differing CTE in each layer.

The target material is then deposited onto the graded coefficient of thermal expansion material layers. The target material may be deposited by using CVD, PVD, LPPS, or other methods know to those in the art. Optionally, if the target material is a solid, its shape must be formed to fit the substrate with the graded CTE layers positioned there between.

The last step in the method is to heat the x-ray anode at a temperature that will bond the target material, the graded coefficient of thermal expansion material layers, and the substrate material together. The temperature and duration of the heat-treating will be dependent upon the material combination of the substrate, the slurry used to form the graded CTE layers, and the target. A method of heat-treating is cited in the referenced patent (see above) and is known to those having skill in the art. A typical heat-treating temperature for layers containing Hf compounds is 1865° C. and for layers containing no Hf compounds is 2350° C.

One example of making an x-ray anode is by heat-treating it at a temperature of 1865° C. after the x-ray anode is made. The x-ray anode is made from a substrate having a woven structure of high strength carbon fibers, three CTE material layers applied to the substrate that forms the graded CTE layer, where each of the three layers are made from a slurry mixture (containing W, W2B, HfC, Hf, chopped pitch carbon fibers, and binders) with a differing CTE in each layer and each layer is sintered after it is applied, and a target made from tungsten alloy (95% W, 5% Re) using PVD method to deposit the target material upon the surface of the graded CTE layer.

Another example of making an x-ray anode is by heat-treating it at a temperature of 2350° C. after the x-ray anode is made. The x-ray anode is made from a substrate having a woven structure of high strength carbon fibers, two CTE material layers applied to the substrate that forms the graded CTE layer, where each of the three layers are made from a slurry mixture (containing W, W2B, WC, chopped carbon fibers, and binders) with varying CTEs in each layer and each layer is sintered after it is applied, and a target made from tungsten alloy (95% W, 5% Re) using LPPS method to deposit the target material upon the surface of the graded CTE layer.

Optionally, the heat-treating may include a weight applied to the target material to facilitate the bonding process of the materials.

While the invention has been described in connection with one or more embodiments, it should be understood that the invention is not limited to those embodiments. On the contrary, the invention is intended to cover all alternatives, modifications, and equivalents, as may be included within the spirit and scope of the appended claims. The disclosures of all U.S. patents mentioned hereinbefore are expressly incorporated by reference.

The invention claimed is:

1. An x-ray anode comprising:

a substrate material comprising a carbon-fiber material;

a target material; and one or more graded CTE material layers coupling the substrate material to the target material.

2. The x-ray anode of claim 1 wherein the target material is a refractory metal.

3. The x-ray anode of claim 1 wherein the target material is a tungsten alloy.

4. The x-ray anode of claim 1 wherein the target material is a molybdenum alloy.

5. The x-ray anode of claim 1 wherein each of the one or more graded CTE material layers is layered sequentially from the substrate material.

6. The x-ray anode of claim 5 wherein each of the one or more graded CTE material layers is layered horizontally from a substrate surface.

7. The x-ray anode of claim 1 wherein each of the one or more graded CTE material layers has an approximate coefficient of thermal expansion averaging between each of the adjacent materials.

8. The x-ray anode of claim 1 wherein each of the one or more graded CTE material layers has a differing coefficient of thermal expansion.

9. The x-ray anode of claim 8 wherein the differing coefficient of thermal expansion of $2\times10^{-6}/°$ C.

10. The x-ray anode of claim 8 wherein the differing coefficient of thermal expansion of $1\times10^{-6}/°$ C.

11. The x-ray anode of claim 8 wherein the differing coefficient of thermal expansion less than $1\times10^{-6}/°$ C.

12. The x-ray anode of claim 1 wherein the x-ray anode is a rotating x-ray anode.

13. An x-ray anode comprising:

a substrate material;

a target material; and one or more graded CTE material layers coupling the substrate material to the target material: wherein each of the one or more graded CTE material layers comprises tungsten, tungsten borides, tungsten carbides, molybdenum, molybdenum borides, molybdenum carbides, hafnium, hafnium carbides, or binders, together with chopped carbon fiber, wherein varying the coefficient of thermal expansion is achieved by altering the proportions of the carbon fiber material.

14. The x-ray anode of claim 13 wherein the carbon fiber is chopped pitch fibers.

15. An x-ray anode comprising:

a substrate material comprising a carbon-fiber material;

a target material; and one or more graded CTE material stratum coupling the substrate material to the target material.

16. The x-ray anode of claim 15 wherein each of the one or more graded CTE material stratum has a determined coefficient of thermal expansion thereby providing CTE strata between said substrate material and said target material.

17. An x-ray anode comprising:

one or more graded CTE material layers;

a substrate material having a target location coated with a slurry mixture and dried, thereby forming one layer of said one or more graded CTE material layers; and a target material deposited upon the last of said one or more graded CTE material layers, wherein said one or more graded CTE material layers, said substrate material and said target material are bonded; wherein said slurry mixture for forming each of said one or more graded CTE material layers have different CTE determined by the percentage of carbon in said slurry mixture.

* * * * *